United States Patent [19]

Sugiura

[11] Patent Number: 4,658,369

[45] Date of Patent: Apr. 14, 1987

[54] SOUND SYNTHESIZING APPARATUS

[75] Inventor: Youji Sugiura, Motosu, Japan

[73] Assignee: Sanyo Electric Co., Ltd, Japan

[21] Appl. No.: 474,578

[22] PCT Filed: Jun. 18, 1982

[86] PCT No.: PCT/JP82/00233

§ 371 Date: Feb. 17, 1983

§ 102(e) Date: Feb. 17, 1983

[87] PCT Pub. No.: WO82/04493

PCT Pub. Date: Dec. 23, 1982

[30] Foreign Application Priority Data

Jun. 18, 1981 [JP] Japan ..... 56-94802

[51] Int. Cl.[4] ..... G10L 5/00

[52] U.S. Cl. ..... 364/513.5; 381/34

[58] Field of Search ..... 381/29-54; 364/513.5, 513

[56] References Cited

U.S. PATENT DOCUMENTS

| | | | |
|---|---|---|---|
| Re. 31,172 | 3/1983 | Nishimura et al. | 381/32 |
| 3,369,077 | 2/1968 | French et al. | 381/38 |
| 3,575,555 | 4/1971 | Schanne | 381/51 |
| 3,588,353 | 6/1971 | Martin | 381/51 |
| 4,369,336 | 1/1983 | Agnello | 381/34 |
| 4,464,784 | 8/1984 | Agnello | 381/34 |

*Primary Examiner*—E. S. Matt Kemeny

*Attorney, Agent, or Firm*—Darby & Darby

[57] ABSTRACT

Smooth transition between concatenated compiled sound elements is achieved by use of an address control unit which is initialized to a point in time corresponding to the maximum similarity between adjacent sound units. A sound synthesizing apparatus for achieving compiling synthesization by the use of sound elements extracted from an analog sound waveform, wherein an analog sound signal is converted into a digital signal, data in the vicinity of the trailing end portion of a preceding sound element and data in the vicinity of the leading end portion of a succeeding sound element are shifted relatively and an arithmetic operation of similarity is made by arithmetic control means, and data of the succeeding sound element is clocked out from a storage means such that the succeeding sound element is connected to the preceding sound element most smoothly. Accordingly, occurrence of a harmonic noise and degradation of an S/N ratio of a synthesized sound and a intelligibility due to an abrupt change of the waveform which occurred at the junction between the preceding sound element and the succeeding sound element, i.e. the discontinuity of the waveform, are almost eliminated, whereby a synthesized sound without discontinuity of the waveform at the junction and fluctuation of a pitch frequency can be obtained.

6 Claims, 9 Drawing Figures

SOUND SYNTHESIZING APPARATUS

FIELD OF THE ART

The present invention relates to a sound synthesizing apparatus for achieving compiling synthesization by the use of sound elements extracted from an analog sound waveform. More specifically, the present invention relates to a sound synthesizing apparatus wherein an analog sound signal is converted into a digital signal, data in the vicinity of the trailing end portion of a preceding sound element and data in the vicinity of the leading end portion of a succeeding sound element are shifted relatively and compared with each other, and data of the succeeding sound element is clocked out from a storage means such that the succeeding sound element is connected to the preceding sound element most smoothly.

BACKGROUND ART

Generally, it can be said that the quality of a sound signal (word, phrase, a talking voice) synthesized by connecting compilation of sound elements, i.e. words, syllables, or shorter sound segments is determined by processing of the junction of the sound elements that are the constitution units of a sound. For example, an abrupt change of the waveform occurring at the junction, i.e. the discontinuity of the waveform becomes a cause of a harmonic noise, which degrades a signal to noise ratio of a synthesized sound and the intelligibility. It is also known that a fluctuation of the pitch frequency which is the fundamental frequency of the vocal chords deteriorates the naturalness of a synthesized sound. The auditory sensation of a human being is extremely sensible with respect to the fluctuation of the pitch frequency (the limit of perception is allegedly 0.1 percent) and the discontinuity of the pitch frequency of the connected sound elements makes a synthesized sound offensive and unnatural.

FIG. 1 is a block diagram showing a conventional time axis expanding apparatus. Referring to FIG. 1, the reference numeral 1 denotes a sound input terminal, the reference numeral 2 denotes an output terminal, the reference numerals 3 and 4 denote N-bit analog shift registers of such as BBD, and the reference numeral 5 denotes a low-pass filter (LPF). The reference numerals 6, 7, 8 and 9 denote analog switches, which serves to controllably switch a sound signal being fed from the input terminal 1 through the analog shift register 3 or 4 and the low-pass filter 5 to the output terminal 2. These analog switches are adapted to be on/off controlled, as shown, responsive to the Q and $\overline{Q}$ outputs of a frequency divider 11 which frequency divides at 2mN (m will be described subsequently) the output of a write clock generator 10 for the analog shift registers 3 and 4.

The analog shift registers 3 and 4 are write clock controlled alternately responsive through OR gates 14 and 15 to the AND gates 12 and 13 of the clock generator 10 and the Q and $\overline{Q}$ outputs of the frequency divider 11, and read clock controlled alternately responsive through the same OR gates 14 and 15 to the AND gates 17 and 18 of the read clock generator 16 and the Q and $\overline{Q}$ outputs of the frequency divider 11. More specifically, a sound signal applied to the input terminal the time axis of which has been compressed by m times ($m>1$), for example, (such compressed signal is obtained by increasing the reproduction speed of a tape recorder by m times as compared with the recording speed, for example) is written into the analog shift register 4 through the analog switch 8 when the Q output of the frequency divider 11 is the logic one. The bit number of the shift register is N and accordingly if the input sound signal is sequentially loaded as a sampled train of the number mN, the trailing end portion of the number N of the sampled train of the number mN is stored in the shift register, the Q output of the frequency divider 11 is reversed to the logic zero, whereby the switch 8 is interrupted. At the same time the $\overline{Q}$ output of the frequency divider becomes the logic one, whereby the switch 6 is conducted, whereupon the analog shift register 3 effects a write operation in the same manner. As seen from the structure shown in the figure, the analog shift register 4 is clocked at that time by the read clock generator 16 and a read operation is achieved through the switch 9 controlled responsive to the $\overline{Q}$ output in the same manner. During the write period of the analog shift register 3 the other analog shift register 4 thus effects a read operation, whereupon when the Q and $\overline{Q}$ outputs of the frequency divider 11 are reversed again the analog shift register 4 effects a write operation and the analog shift register 3 effects a read operation. Now assuming that the clock frequency of the write clock generator 10 is $f_1$, and the clock frequency of the read clock generator 16 is $f_2$ and the respective clock frequencies are determined to satisfy the following equation:

$$f_1/f_2=m \tag{1}$$

then the time axis is expanded by m times and the compressed sound as inputted to the sound input terminal 1 appears at the output terminal 2 with the time axis regained. Naturally, the read clock frequency $f_2$ is determined to satisfy a Nyquist sampling theory with respect to a necessary output sound frequency band.

With the above described conventional apparatus, the jointing timing of the sound elements alternately outputted from the analog shift registers 3 and 4 is automatically determined per $mN/f_1$ second responsive to the output of the frequency divider 11 for frequency dividing the write clock 10 by the factor 2mN. Therefore, a discontinuous waveform variation and a fluctuation of the pitch frequency are caused at the junction of the sound elements, as shown in FIG. 2. As described previously, the discontinuity of the waveform and the pitch at the junction of the sound elements considerably degrades the sound quality and the intelligibility.

DISCLOSURE OF THE INVENTION

A sound synthesizing apparatus in accordance with the present invention achieves compiling synthesization by the use of sound elements extracted from an analog sound waveform, wherein (a) an analog sound input signal is converted into a digital signal by an A-D converting means for converting the analog sound input signal into the digital signal, (b) an output of the converting means is stored in a digital storage means responsive to a first clock, (c) a digital value in the vicinity of the trailing end portion of a preceding sound element and a digital value in the vicinity of the leading end portion of a succeeding sound element converted from the analog sound input signal are sampled responsive to the first clock, an arithmetic operation of similarity between the sampled trains of both sound elements is made while the sampled trains of both sound elements, as sampled, are made to relatively correspond with each other, and a value of a counter is initialized by an arithmetic control means for initializing the value of the counter in accordance with the corresponding relation of both sampled trains at the time point where the similarity is maximum, and (d) the digital signal read from the digital storage means is converted into the analog signal whereupon the analog sound signal is reproduced by a digital-analog converting means, whereupon the counter is advanced by a second clock and designates an address of the digital storage means where the stored contents are read.

Therefore, according to the present invention, a time axis converting means for providing a smooth junction by the operation of the arithmetic control circuit can be obtained, whereby a synthesized sound without a discontinuity of the junction waveform and a fluctuation of a pitch frequency included in a conventional apparatus can be obtained.

BEST MODE FOR CARRYING OUT THE INVENTION

The present invention enables provision of a synthesized sound of a high quality through combination of the respective sound elements in a natural form by recognizing the patterns of the sound element waveforms. To provide sound element waveforms, various approaches have been employed such as utilizing those sampled per pitch period for example from a natural sound, taking a synthesized one element component by the use of a separate sound synthesizing apparatus, and the like; however, the present invention aims to provide a method for combining the sound elements of a relatively short time period, specifically of several tens milli seconds, without the discontinuity of waveforms and a fluctuation of the pitch frequency at the junction. More specifically, it is supposed that the sound elements of such a shorter time period must have been similar to each other in the waveforms, at least with respect to the jointing portions of the adjacent sound elements and accordingly the jointing portions can be combined smoothly by slightly correcting the time axis of the respective sound elements. According to the present invention, similarity of the waveforms is evaluated in terms of a level of the signal with respect to the jointing portions of the sound elements being combined, whereupon proper timing modification is made to the time axis of the sound elements.

Figure 3:
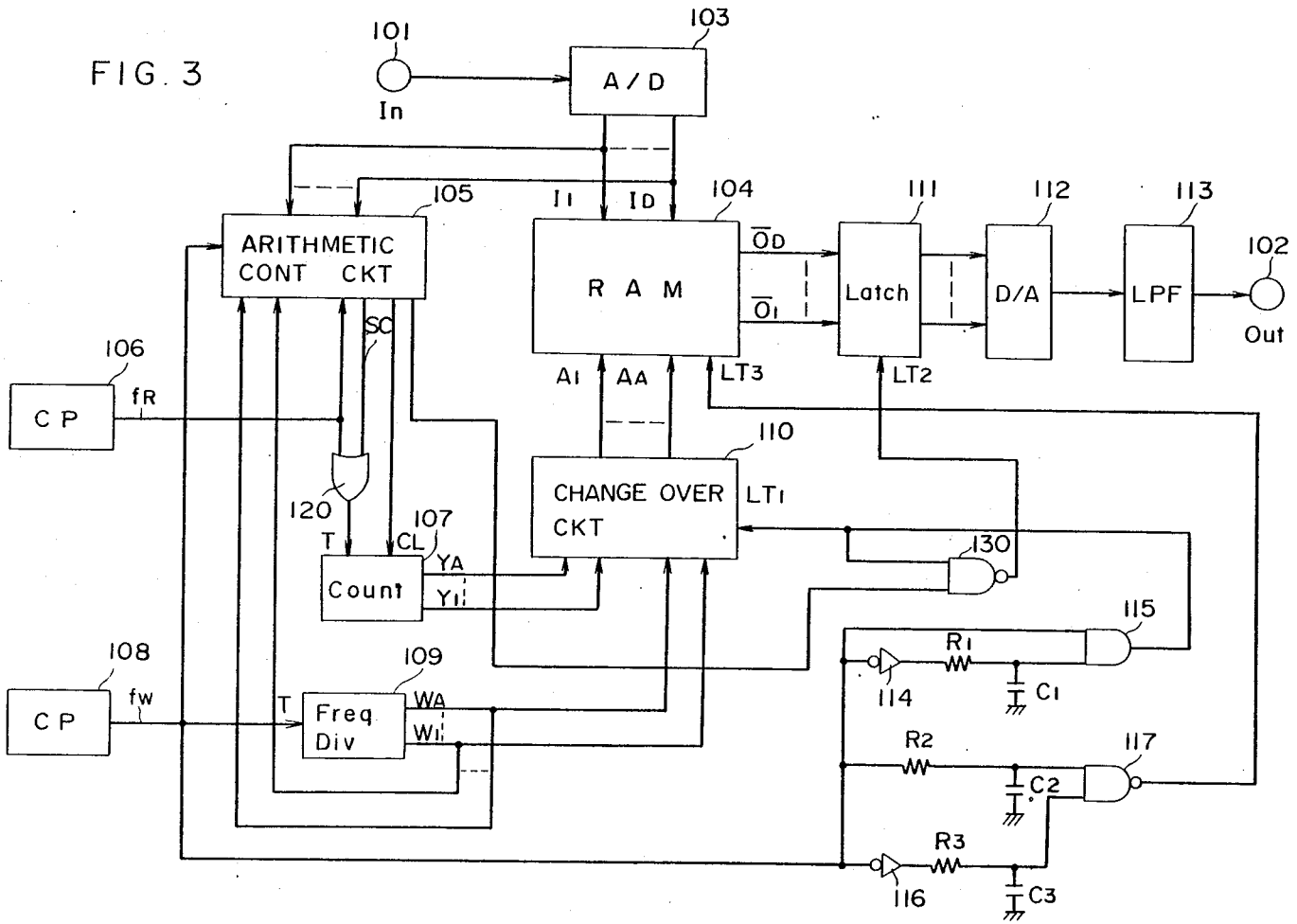
FIG. 3 is a block diagram showing a structure of the sound synthesizing apparatus of the present invention.

Now the present invention for eliminating the shortcomings of the conventional apparatus will be described with reference to a block diagram shown in FIG. 3. Referring to the same figure, the reference numeral 101 denotes a sound signal input terminal, the reference numeral 102 denotes a sound signal output terminal and the reference numeral 103 denotes an analog-digital converting circuit (hereinafter referred to as A/D) for converting the sound signal into digital data. The reference numeral 104 denotes a random-access memory (hereinafter referred to as RAM) having a memory capacity of $2^A$-byte for storing a digital value given to data input terminals $I_1$ to $I_d$ (a less significant one is $I_1$) in an address given by address input terminals $A_1$ to $A_a$ (a less significant one is $A_1$) when a control input terminal LT3 is the logical level "0". When the control input terminal LT3 is the logical level "1", the contents of the address given by the address input terminal $A_1$ to $A_a$ are outputted to data output terminals $O_1$ to $O_d$. The reference numerals 106 and 108 denote clock generating circuits. An output fR of the clock generating circuit 106 is supplied to a clock input terminal T of a read counter 107 through an OR gate 120, whereby an output of the read counter 107 is advanced. The read counter 107 is a counter of A-bit, whereupon an initial value is set by the output of the arithmetic control circuit 105. Now a way of setting the initial value will be described.

First, the arithmetic control circuit 105 clears the output of the read counter 107 by providing a pulse to a clear input terminal CL of the read counter 107. Thereafter, the initial value of the read counter 107 is set by the pulses of the initializing number which is provided from an SC (Set Counter) terminal of the arithmetic control circuit 105 to an input of the OR gate 120. The setting period of the initial value is adapted to be a period in which the output fR of the clock generating circuit 106 is counted by a predetermined number and, therefore, the output value of the read counter 107 at this time is commensurate with a value obtained by adding the predetermined number to the initialized value during the preceding period, and it is sufficient that the clock of the number obtained by subtracting the output value of the read counter 107 from a value to be newly initialized is supplied to the clock input terminal T through the OR gate 120. In this case it is unnecessary to clear the read counter. Meanwhile, the above described advancement of the read counter 107 by the arithmetic control circuit 105 must be done while the output fR of the clock generating circuit 106 is the logical level "0".

Figure 4:
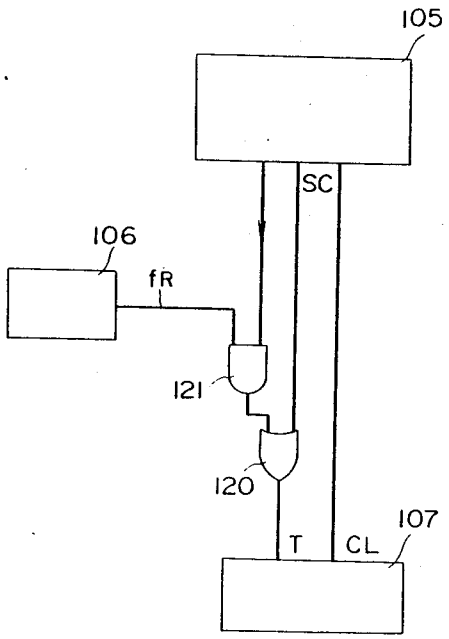

In making the above described setting even when the fR is the logical level "1", an AND gate 121 is provided as shown in FIG. 4 at the input terminal of the OR gate 120 from the fR, the fR is supplied to one input terminal of the AND gate, the output terminal of the arithmetic control circuit 105 is connected as an input to the other input terminal thereof, the output of the AND gate 121 is connected to the input terminal of the OR gate 120, and one of the inputs to the AND gate 121 is inhibited by the arithmetic control circuit 105, whereby the initial value of the read counter 107 can be set even when the logical level of the fR is either "0" or "1".

Figure 5:
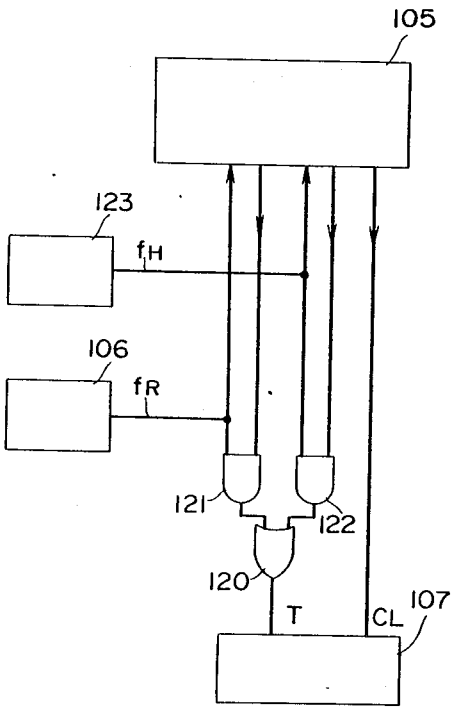
FIGS. 4 and 5 are circuit diagrams showing examples of structures of major portions in initializing the read counter 107 of FIG. 3.

The initialization of the read counter 107 by the arithmetic control circuit 105 is, as shown in FIG. 5, achieved in the same manner by using an output fH of the clock generating circuit 123. In this case, the fH is a clock of sufficiently high frequency as compared with the fR, and is connected to the one input terminal of the AND gate 122 and to the one input terminal of the arithmetic control circuit 105. The arithmetic control circuit 105 provides, when initializing the read counter 107, the logical level "0" to the input of the AND gate 121 and the logical level "1" to the input of the AND gate 122, and when the output of the clock circuit 123 is counted by the predetermined number, the arithmetic control circuit 105 can initialize the read counter by returning the input of the AND gate 121 to the logical level "1" and the logical level of the AND gate 122 to "0". It is apparent that the same is achieved by constituting the read counter with a preset counter and presetting the initial value directly.

After the initialization was achieved in this way, the read counter divides frequency of the fR. The less significant bit of the outputs $Y_1$ to $Y_a$ of the read counter is $Y_1$.

Figure 6:
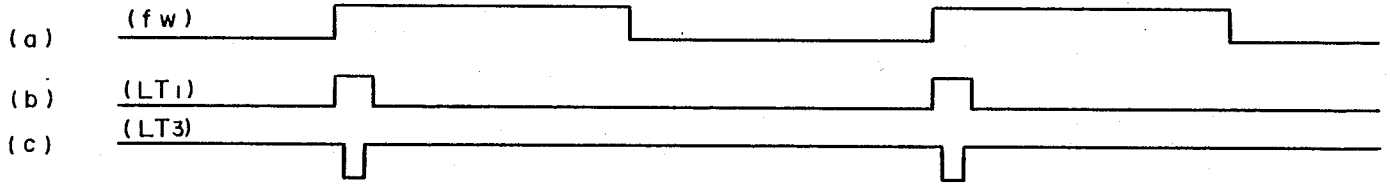
FIG. 6 is a view for showing a time chart for explaining outputs of the gates 115 and 117 of the apparatus in FIG. 3.

Now, the clock generating circuit 108 provides the clock timing for the RAM 104. The output fW of the clock generating circuit 108 is provided as an input to the clock input terminal T of the frequency dividing circuit 109 of A-bit, whereby the outputs $W_1$ to $W_a$ (a less significant one is $W_1$) of the frequency dividing circuit 109 are advanced successively. The reference numeral 110 denotes a change over circuit for outputting the outputs $W_1$ to $W_a$ of the frequency dividing circuit 109 to the address inputs $A_1$ to $A_a$ of the RAM 104 when the control input LT1 is the logical level "1", and outputting the output of the read counter 107 to the address inputs $A_1$ to $A_a$ of the RAM 104 when the control input LT1 is the logical level "0". The reference numerals 114 and 116 denote inverters, the reference numeral 115 denotes an AND gate and the reference numeral 117 denotes a NAND gate. The reference characters $R_1$, $R_2$ and $R_3$ denote resistors and the reference characters $C_1$, $C_2$ and $C_3$ denote capacitors. The $R_1$ and the $C_1$, the $R_2$ and the $C_2$, and the $R_3$ and the $C_3$ constitute integrating circuits, respectively. Assuming that time constants of the integrating circuits are $\tau_1$, $\tau_2$ and $\tau_3$, respectively, these are selected such that all of them are sufficiently smaller than the period of the write clock fW, and that the relationship between them is $\tau_1 > \tau_3 > \tau_2$. More specifically, as shown in FIG. 6, the output (b of the same figure) of the AND gate 115 becomes the logical level "1" in response to the rise of the fW (a of the same figure), and falls in response to the charging of the capacitor $C_1$ with the time constant $\tau_1$. The output (c of the same figure) of the NAND gate 117 falls with a delay as compared with the rise of the fW (a of the same figure), and rises before the falling time point of the output of the AND gate 115. The reference numeral 111 denotes a latch circuit for transferring the input to the output when the logical level of the control input terminal LT2 is "0", and latching and outputting the data at the rising time point when the logical level is "1". The reference numeral 112 denotes a digital-analog converting circuit (hereinafter referred to as D/A) for converting a digital value to an analog value. The reference numeral 113 denotes a low-pass filter for removing a sampling noise of the D/A converted sound signal. The reference numeral 130 denotes a NAND gate, wherein the output of the AND gate 115 and the output of the arithmetic control circuit 105 are connected as an input thereof, and the output thereof is connected to the LT2 input of the latch circuit 111. The arithmetic control circuit 105 outputs the logical level "0" to the NAND gate 130 while setting the initial value of the read counter 107. Thus, the latch circuit 111 is constructed such that the input is not transferred to the output in the transient state when the initial value of the read counter is set.

With such structure, the sound signal supplied to the input terminal is converted into the digital value by the A/D 103 and is stored in the RAM 104 responsive to the cycle of the write clock fW. Namely, when the output of the AND gate 115 is "1", the output of the frequency dividing circuit 109 is supplied to the address inputs $A_1$ to $A_a$ of the RAM 104, the control input terminal LT3 becomes "0", whereby the output of the A/D 103 is stored. As the frequency dividing circuit 109 is advanced responsive to the cycle of the fW, the addresses of the RAM 104 wherein the sound signal is sampled and stored are continuous. However, the address of $2^A$ becomes zero. The sound signal sampled with the write clock fW and stored in the RAM 104 in the form of the digital value is read with the read clock fR, and is D/A converted, whereby the sound signal is reproduced in the form of the analog signal. The ratio of the write clock fW to the read clock fR becomes such ratio that has the time axis converted. The reason why the latch circuit 111 is provided is to prevent the address contents from being read in error on the occasion of writing in the RAM 104. Namely, reading of the RAM 104 is always in progress at any other time than writing.

Figure 1:
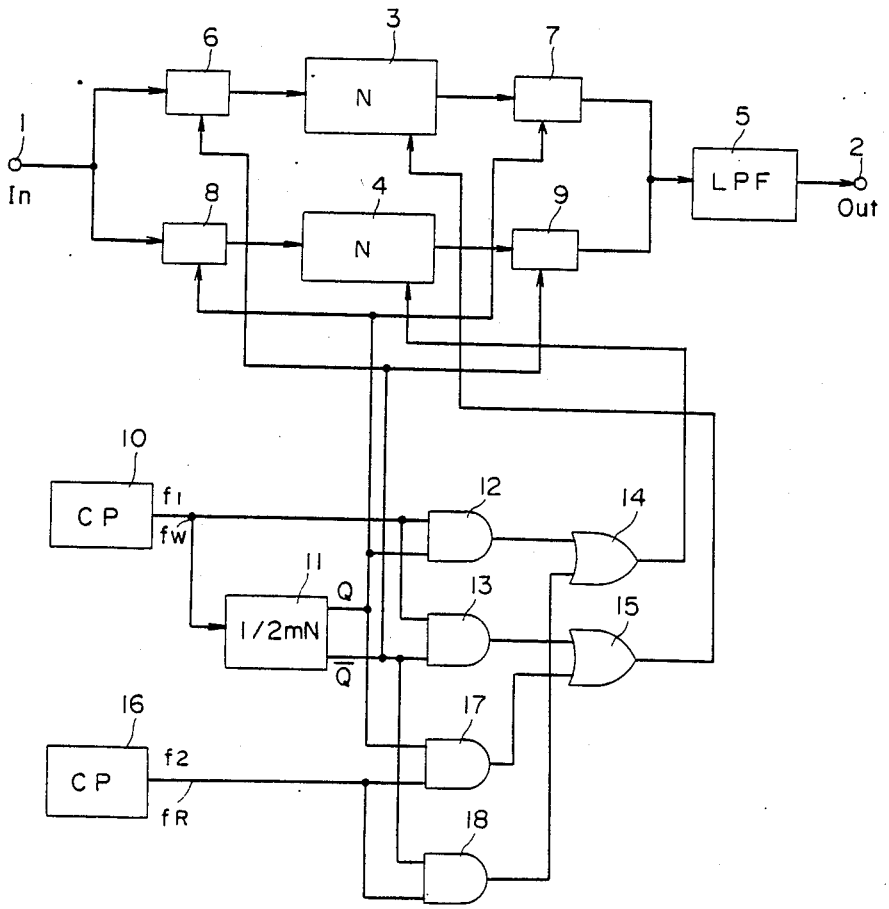
FIG. 1 is a block diagram showing a conventional sound synthesizing apparatus.
Figure 2:
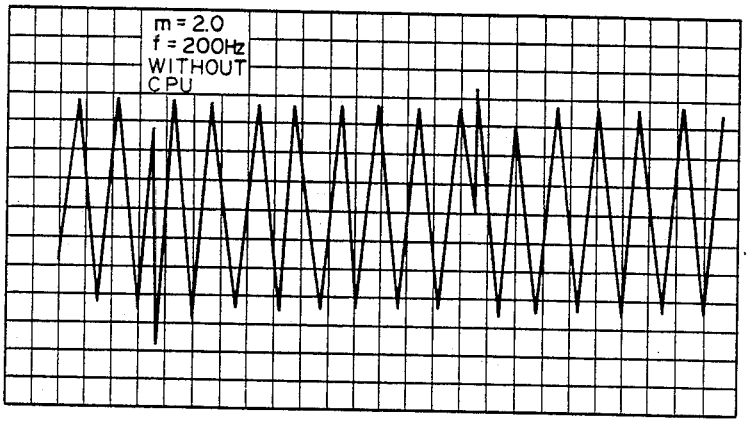
FIG. 2 is a view for showing the characteristic of the conventional apparatus.
Figure 7:
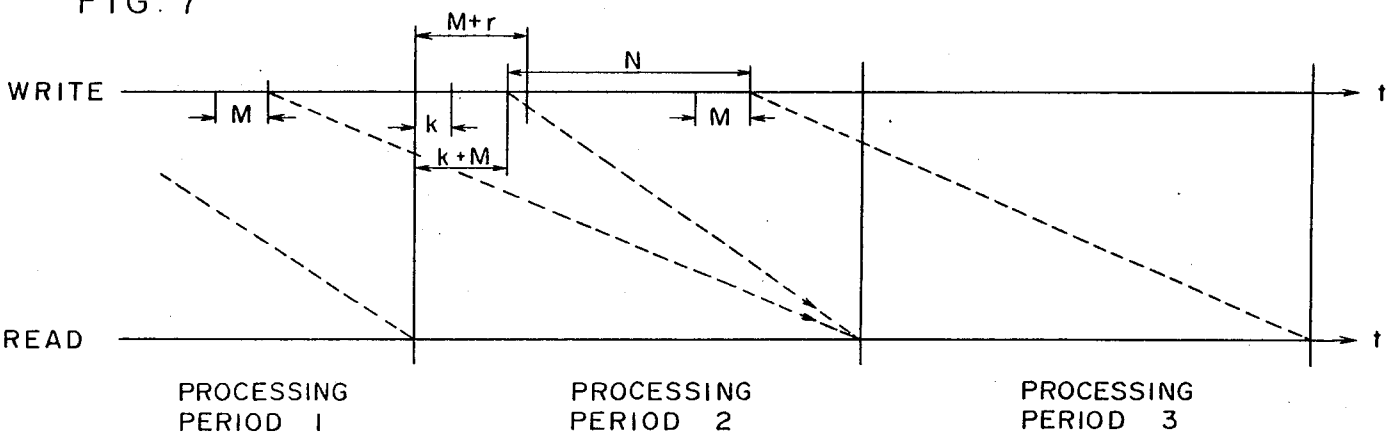
FIG. 7 is a view for showing a time chart for explaining the function of the arithmetic control circuit 105 of the apparatus in FIG. 3, and FIGS. 8A and 8B are graphs showing the waveform of sampled trains $X_p$ and $Y_p$ of the preceding sound element of the number M and the succeeding sound elements of the number M+r, respectively.

As thus described in conjunction with the conventional apparatus shown in FIG. 1, the present invention effects a timing modification with respect to the junction of the sound elements being jointed, which is achieved by the arithmetic control circuit 105. The arithmetic control circuit 105 may be an arithmetic processing apparatus (CPU)(computer) programmed by means of the RAM. FIG. 7 is a view showing the operation of the arithmetic control circuit 105. Each processing period shown denotes a period wherein the read clocks are counted by the number of N. Hereinafter, the time axis t direction is described in terms of the unit of the write clock fW. The sampled trains of the number M in the trailing end out of the sound element sampled trains of the number N read during the [processing period 2] are stored during the [processing period 1] with the write clock fW. The sampled trains of the number M+r from the start of the [processing period 2] are picked up, whereby a point K of high correlation is evaluated with respect to the thus obtained sampled trains and the above described sampled trains of the number M. The way to evaluate the K will be described later. Since the correlation between the above described sampled trains of the number M and the sampled trains of the number M starting from the time point after the lapse of K samples from the start of the [processing period 2] is high, at the leading end of the [processing period 3], the output of the read counter 107 is initialized to the output value of the frequency dividing circuit 109 at the time point after the lapse of the K+M samples from the start of the [processing period 2]. Therefore, the sampled trains of the sound waveform read out at the junction of the [processing period 2] and the [processing period 2] can be joined continuously. The sampled trains of the number M from the time point being counted by the write clocks fW of the number K+N from the start of the [processing period 2] are the sampled trains of the number M in the trailing end portion read out during the [processing period 3], and the same are stored in order to evaluate the junction during the next processing period. Thereafter, when the same operation is achieved per each processing period, the waveform is jointed continuously.

Figure 8:
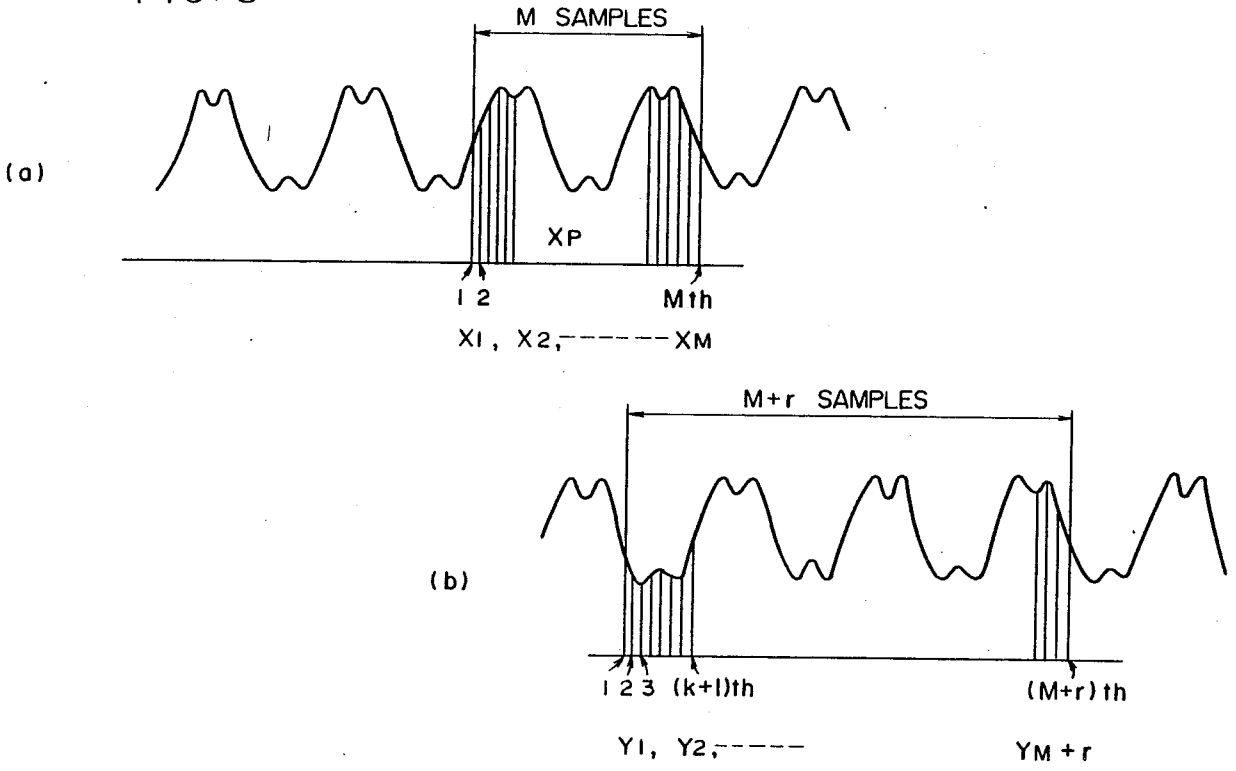

Now, the way to evaluate the value K at the junction of high correlation will be described hereinafter. FIGS. 8(*a*) and (*b*) each shows samples of the number M in the trailing end portion of the preceding sound element written in during the [processing period 1] of FIG. 7 and samples of the number M+r in the leading end portion of the succeeding sound element of the start end during the [processing period 2]. It is assumed that the sample progression of the trailing end portion of the preceding sound element be $X_p$ (p=1, 2, . . . M) and the sample progression of the leading end portion of the succeeding sound element be $Y_p$ (p=1, 2, . . . M+r). The $X_p$ and the $Y_p$ are obtained by sampling the output of the A/D 103 responsive to the write clock fW. In order to evaluate a similarity between the sound elements, it is better to calculate a mean square error $e_k^2$ between the $X_p$ and the $Y_p$. The mean square error $e_k^2$ may be expressed as follows:

$$e_k^2 = \frac{1}{M} \sum_{p=1}^{M} \left( \frac{X_p - \overline{X}}{\sigma X} - \frac{Y_p + K - \overline{Y}}{\sigma Y} \right)^2 \quad (2)$$

where $\overline{X} = \frac{1}{M} \sum_{p=1}^{M} X_p$, $\overline{Y} = \frac{1}{M} \sum_{p=1}^{M} Y_p$, $$\sigma X = \sqrt{\frac{1}{M} \sum_{p=1}^{M} (X_p - \overline{X})^2}, \quad \sigma y = \sqrt{\frac{1}{M} \sum_{p=1}^{M} (Y_p - \overline{Y})^2},$$

$$K = 0, 1, 2, \ldots r - 1$$

This represents the similarity of the sampling waveform $Y_p$, as shifted by the number K and superposed with respect to the sampling waveform $X_p$.

However, the arithmetic processing based on the equation (2) requires a large number of calculating steps and the computer of high performance should be utilized in order to make such calculation in a short period of time such as in a period at least several tens milli seconds. Originally, the equation (2) aims to investigate the cross correlation of two waveforms of different amplitudes and levels and therefore the waveform is normalized by the standard deviation $\sigma_X$, $\sigma_Y$ and then a square sum of the differences between the average levels $\overline{X}$, $\overline{Y}$ is evaluated, whereupon an error is evaluated. However, in case of the inventive sound synthesizing apparatus, the sound elements being treated are of the waveform close to each other in terms of the time and accordingly it can be deemed that the amplitudes and the levels of them resemble each other. In this case, the difference between two waveforms may be expressed by the following equation, rather than the equation (2):

$$e_k^2 = \frac{1}{M} \sum_{p=1}^{M} (X_p - Y_{p+k})^2 \quad (3)$$

In addition, in case of the present invention, it is done sufficiently by obtaining the timing of the maximum similarity of two waveforms and accordingly the equation (3) may be further deformed as the following equation (4):

$$e_k = \sum_{p=1}^{M} |X_p - Y_{p+k}| \quad (4)$$

In this case, only the most significant digit of the A/D converter may be used as the $X_p$ and the $Y_{p+k}$. And also the polarity in the vicinity of the zero crossing point of the input signal may be used. In this case, both the $X_p$ and the $Y_{p+k}$ are [1] or [0]. Namely, the equation means an integration of the absolute values of the differences of the respective corresponding sampling values, and the jointing timing is determined by evaluating k which makes the integration minimum.

In case of the present invention, in order to minimize a calculating processing time, the following equation may be calculated rather than the equation (4):

$$g_k = \sum_{p=1}^{M} (X_p \otimes Y_{p+k}) \quad (5)$$

In the equation (5), the $X_p$ and the $Y_{p+k}$ are the most significant digit of the A/D converter, and are [1] or [0]. The $\otimes$ denotes a character which evaluates an exclusive logical sum. Therefore, the $X_p \otimes Y_{p+k}$ shows the exclusive logical sum of the $X_p$ and the $Y_{p+k}$, whereupon the [0] is evaluated when both of the $X_p$ and the $Y_{p+k}$ are [1] or [0], and the [1] is evaluated in the other case. The similarity between the binary signal sampling data $X_p$ in the trailing end portion of the preceding sound element and the binary signal sampling sound data $Y_p$ in the leading end portion of the succeeding sound element is given by the $g_k$, and the jointing timing is determined by evaluating k which makes the $g_k$ minimum. More specifically, the arithmetic control circuit 105 is adapted such that $g_k$ is evaluated with respect to k=0, 1, . . . , r−1, whereupon k which makes the $g_k$ minimum is determined. Namely, as shown in FIG. 8, it follows that the error becomes minimum when the sampled trains of the number M in the trailing end portion of the preceding sound element are connected to the portion as shifted by the number k from the leading end of the succeeding sound element.

As described previously, the arithmetic control circuit 105 samples, responsive to the write clock fW of the output of the clock generating circuit 108, the digital value obtained by converting, by the A/D 103, the sound signal supplied to the input terminal 101, whereby the sampled trains $X_p$ and $Y_p$ are obtained. The timings to take in the sampled trains $X_p$ and $Y_p$ are all designated by the value of the outputs $W_1$ to $W_a$ of the frequency dividing circuit 109. The arithmetic control circuit 105 also counts the read clock of the output of the clock generating circuit 106, and sets the initial value of the read counter 107 when the clocks are counted by the number of N, and enters into the next processing period. This value to initialize the read counter is that which is obtained by adding the designating value of the frequency dividing circuit at the time when the $Y_p$ is taken in to the k obtained by calculating $X_p$ and $Y_p$.

Meanwhile, the sampled train with which the arithmetic control circuit 105 evaluates the similarity may be a one which is obtained by sampling, according to the first clock fW, a one obtained by converting the analog input signal supplied to the input terminal 101 into the digital value by a separate A/D converter which differs from the A/D converter 103 or by a zero crossing polarity detecting circuit (not shown).

Although a description about the fundamental embodiment of the present invention has been made in the foregoing, the present invention is not limited to the embodiment and various structures can be taken in the scope of the appended claims.

I claim:

1. A sound synthesizing apparatus for achieving compiling synthesization by the use of sound elements extracted from an analog sound waveform, the apparatus comprising:

(a) first clock means for providing a first clock signal having a first frequency;

(b) second clock means for providing a second clock signal having a second frequency, (c) converting means for converting an analog input signal of said analog sound waveform into a digital signal having a plurality of bits, (d) digital storage means for storing an output of the converting means in response to said first clock signal, (e) address control means for controlling and designating an address for reading stored contents of said digital storage means, being advanced by said second clock signal;

(f) arithmetic control means for sampling, in response to the first clock signal, a digital value in the vicinity of the trailing end portion of a preceding sound element obtained by converting the analog input signal and another digital value in the vicinity of the leading end portion of a succeeding sound element and thereby providing sampled trains of both of said sound elements, and for making an arithmetic operation of similarity between the sampled trains of both said sound elements while the sampled trains of both said sound elements, as sampled, are made to relatively correspond with each other, and for initializing a value of said address control means in accordance with a corresponding relation of both sampled trains at the time point where the similarity is maximum, and (g) digital/analog converting means for converting the digital signal read from said digital storage means into an analog signal and for reproducing the analog sound signal.

2. A sound synthesizing apparatus in accordance with claim 1, wherein said arithmetic control means samples, responsive to said first clock, at least one of the most significant bit or some more significant bit of the output from the converting means for converting the analog input signal into the digital signal thereby providing sampled bit trains of both of said sound elements and makes the arithmetic operation of similarity between the sampled bit trains of both said sound elements while both the sampled bit train in the vicinity of the trailing end portion of the preceding sound element and the sampled bit train in the vicinity of the leading end portion of the succeeding sound element, as sampled, are made to relatively correspond with each other.

3. A sound synthesizing apparatus in accordance with claim 1, wherein said arithmetic control means samples, responsive to said first clock, a digital value obtained by converting the input analog signal of said analog sound waveform by a separate second analog/digital converting means and makes the arithmetic operation of similarity between the sampled bit trains of both said sound elements while both the sampled bit train in the vicinity of the trailing end portion of the preceding sound element and the sampled bit train in the vicinity of the leading end portion of the succeeding sound element, as sampled, are made to relatively correspond with each other.

4. A sound synthesizing apparatus in accordance with claim 3, wherein the second analog/digital converting means is a zero crossing polarity detecting circuit which converts the polarity of the value of the analog signal in the vicinity of the zero crossing point of the input analog signal into the digital value.

5. A sound synthesizing apparatus in accordance with claim 1, 2, 3 or 4, wherein the arithmetic control means sets an initial value of said address control means by supplying clock signals to said address control means.

6. A sound synthesizing apparatus in accordance with claim 1, 2 or 3, wherein the address control means is constructed by a counter.

* * * * *